US007246823B2

(12) United States Patent
Laurash et al.

(10) Patent No.: US 7,246,823 B2
(45) Date of Patent: Jul. 24, 2007

(54) BUSINESS FORM WITH LABEL STOCK AND MESSAGE BEARING STOCK

(75) Inventors: David F. Laurash, Dayton, OH (US); Jeffrey D. Kimble, Fairfield, OH (US)

(73) Assignee: The Standard Register Company, Dayton, OH (US)

( * ) Notice: Subject to any disclaimer, the term of this patent is extended or adjusted under 35 U.S.C. 154(b) by 201 days.

(21) Appl. No.: 11/010,586

(22) Filed: Dec. 13, 2004

(65) Prior Publication Data

US 2006/0125230 A1 Jun. 15, 2006

(51) Int. Cl.
*B42D 15/00* (2006.01)

(52) U.S. Cl. ..... 283/81; 283/94; 283/101

(58) Field of Classification Search ..... 283/81, 283/94, 101, 103, 105, 61, 62; 428/40.1, 428/42.2, 42.3, 43; 493/63; 229/300, 70; 40/299.01, 633, 630
See application file for complete search history.

(56) References Cited

U.S. PATENT DOCUMENTS

| | | | | | |
|---|---|---|---|---|---|
| 2,956,465 | A | * | 10/1960 | Mingo | 83/660 |
| 3,111,449 | A | | 11/1963 | Gold et al. | |
| 3,228,710 | A | * | 1/1966 | Chodorowski | 281/38 |
| 4,696,843 | A | * | 9/1987 | Schmidt | 428/42.2 |
| RE33,616 | E | | 6/1991 | Welsch | |
| 5,298,104 | A | | 3/1994 | Absher | |
| 5,411,295 | A | * | 5/1995 | Bates et al. | 283/81 |
| 5,580,640 | A | * | 12/1996 | Kraft et al. | 428/195.1 |
| 5,776,591 | A | | 7/1998 | Mertens | |
| 5,829,790 | A | * | 11/1998 | Phillips | 283/117 |
| 6,572,151 | B2 | * | 6/2003 | Jarvis et al. | 283/101 |
| 6,596,359 | B2 | * | 7/2003 | Roth et al. | 428/40.1 |
| 6,748,687 | B2 | | 6/2004 | Riley | |
| 2002/0102378 | A1 | * | 8/2002 | Rawlings et al. | 428/42.3 |
| 2002/0142122 | A1 | * | 10/2002 | Moliski | 428/42.3 |
| 2002/0195484 | A1 | * | 12/2002 | Rawlings et al. | 229/305 |
| 2003/0224134 | A1 | * | 12/2003 | Roth | 428/42.3 |
| 2004/0191458 | A1 | * | 9/2004 | McKillip | 428/40.1 |
| 2004/0193454 | A1 | * | 9/2004 | Foote et al. | 705/2 |
| 2005/0087976 | A1 | * | 4/2005 | Crum | 283/61 |
| 2006/0051550 | A1 | * | 3/2006 | Arippol | 428/40.1 |

OTHER PUBLICATIONS http://education.yahoo.com/reference/dictionary/entry/adjacent.*

* cited by examiner

*Primary Examiner*—Monica Carter
*Assistant Examiner*—J Williams
(74) *Attorney, Agent, or Firm*—Dinsmore & Shohl LLP

(57) ABSTRACT

A business form according to the present invention including a ply of label stock, a ply of release liner stock, and a ply of message or record bearing stock, may be configured as either a continuous or cut sheet form. The ply of label stock has one side coated with a pressure sensitive adhesive. The ply of release liner stock has a release side that engages with the adhesive on the one side of the label stock. The release liner ply and the label stock ply have edges that are laterally offset from one another so that a narrow longitudinal strip of adhesive is unengaged with the release liner. The ply of message bearing stock is adhered at one edge to the label stock at the narrow longitudinal strip of adhesive. A plurality of cuts is defined by, and extends through, the release liner from the back of the business form, whereby the structural integrity of the business form is enhanced.

24 Claims, 5 Drawing Sheets

BUSINESS FORM WITH LABEL STOCK AND MESSAGE BEARING STOCK

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

Business forms, both continuous forms and sheet forms, that also carry one or more labels, have been widely used. One particularly popular type of label bearing form includes a first section that is provided with one or more labels backed with pressure-sensitive adhesive, and a second, adjacent section on which variable information may be printed and thus retained. This adjacent section may typically be made of material that differs from the label stock used for the adhesive backed labels. This permits the labels to be made from an optimal label material, and the information to be recorded on a different, more suitable material in the adjacent section.

In one such construction, conventional adhesive backed label stock on a release liner is adhered to conventional record keeping stock. A record bearing portion of the business form made of the record keeping stock is glued to the release liner by a line of glue extending along one edge of the release liner on the side thereof opposite the label stock. The record bearing portion can be formed of any suitable or desired material with this construction. In some processing equipment, this type of form can pose a difficulty because of the thickness of the form at the junction of the record or message bearing ply and the release liner. In particular, the thickness of the form at this location is equal to the sum of the thickness of the record or message bearing ply, the thickness of the release liner, the thickness of the label stock, the thickness of the pressure sensitive adhesive between the release liner and the label stock, and the thickness of the glue line adhering the release liner and the record or message bearing stock. This very thick portion of the form adds rigidity that can make processing the form on certain types of equipment difficult. In addition, in some cases, the thickness alone may tend to cause form components to hang up in automated processing equipment.

An improved business form having this type of construction is shown in U.S. Pat. No. RE. 33,616. The '616 patent teaches a continuous business form that includes an elongated ply of label stock of a desired width and having one side coated with a pressure sensitive adhesive. An elongated ply of release liner stock of the same width is engaged with the adhesive in such a way that the plies are laterally offset. Consequently, a narrow longitudinal strip of adhesive is exposed on the label stock ply and used to adhere the label stock ply to an elongated ply of record or message bearing stock. While this improved form eliminates the difficulties encountered with earlier forms resulting from the undue thickness of those forms, this improved form is subject to other problems. One problem encountered is the tendency for the form to separate at the narrow longitudinal adhesive strip. This separation might occur during printing or other machine processing and be total, in which case the form was ruined, and the equipment was jammed. Alternatively, the separation might be very minimal, resulting in no immediate damage to the printer or other equipment, but presenting the possibility that some adhesive from the label stock ply of a number of such business forms might migrate through the form separations and, over time, foul the equipment.

The present invention is directed to overcoming these above problems.

SUMMARY OF THE INVENTION

This need is met by a business form according to the present invention including a ply of label stock, a ply of release liner stock, and a ply of message or record bearing stock. The ply of label stock has a desired width and one side coated with a pressure sensitive adhesive. The ply of release liner stock engages with the adhesive on the one side of the label stock. An edge of the release liner ply and an edge of the label stock ply are laterally offset from one another so that a longitudinal strip of adhesive is unengaged with the release liner. The ply of message bearing stock is adhered at one edge to the label stock at the longitudinal strip of adhesive. A plurality of cuts is defined by, and extends through, the release liner, whereby the structural integrity of the business form is enhanced.

The plurality of cuts may comprise a pair of die cut perforation lines extending along the release liner adjacent the one edge of the message bearing stock. The plurality of die cuts may comprise a pair of perforation lines made up of cuts extending generally parallel to the perforation lines.

The plurality of die cuts may comprise one or more rows of die cuts extending along the release liner adjacent the one edge of the message bearing stock. The die cuts may extend generally perpendicular to the row of die cuts. Alternatively, the die cuts may extend at an oblique angle to the row of die cuts, with the die cuts being generally parallel to each other. Further, alternatively, the die cuts may comprise a first group of generally parallel die cuts inclined at a first oblique angle to the row of die cuts, interleaved with a second group of generally parallel die cuts inclined at a second oblique angle to the row of die cuts. The first oblique angle may be a positive angle and the second oblique angle may be a negative angle.

The label stock and the record or message bearing stock are preferably made of different materials. The die cuts in the label stock define individual labels that may be peeled from the release liner stock.

The business form may be a cut sheet form or a continuous form. The continuous form has elongated plies of label stock, release liner stock, and message bearing stock edges.

It is an object of the present invention to provide business form that includes a label ply and a message ply that are joined along a longitudinally extending seam, and to provide such a business form which resists separation along the seam. Other objects and advantages of the invention will be apparent from the following description, the accompanying drawings, and the appended claims.

DESCRIPTION OF THE PREFERRED EMBODIMENTS

Figure 1:
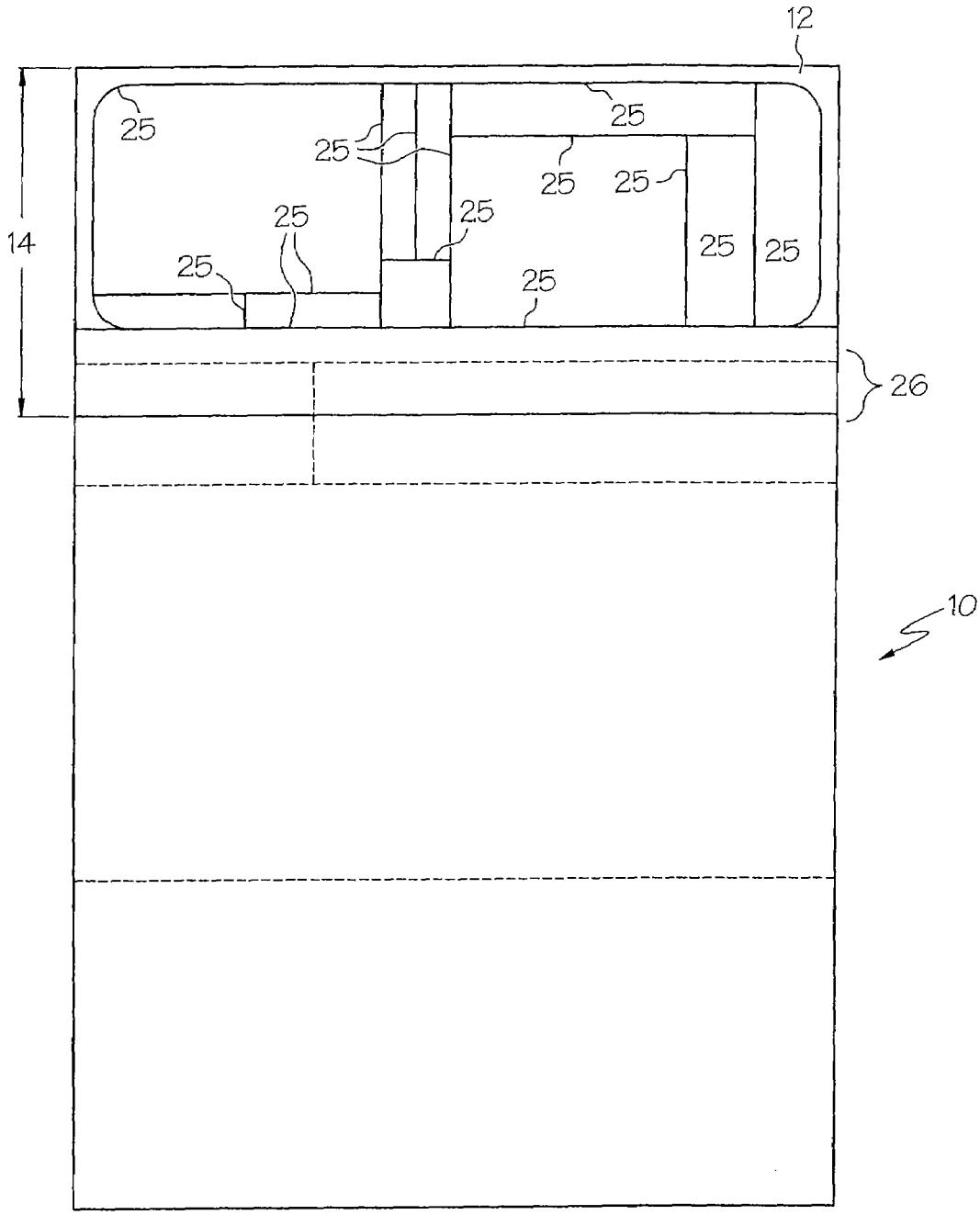
FIG. 1 is a plan view of the front side of a business form constructed according to present invention.
Figure 2:
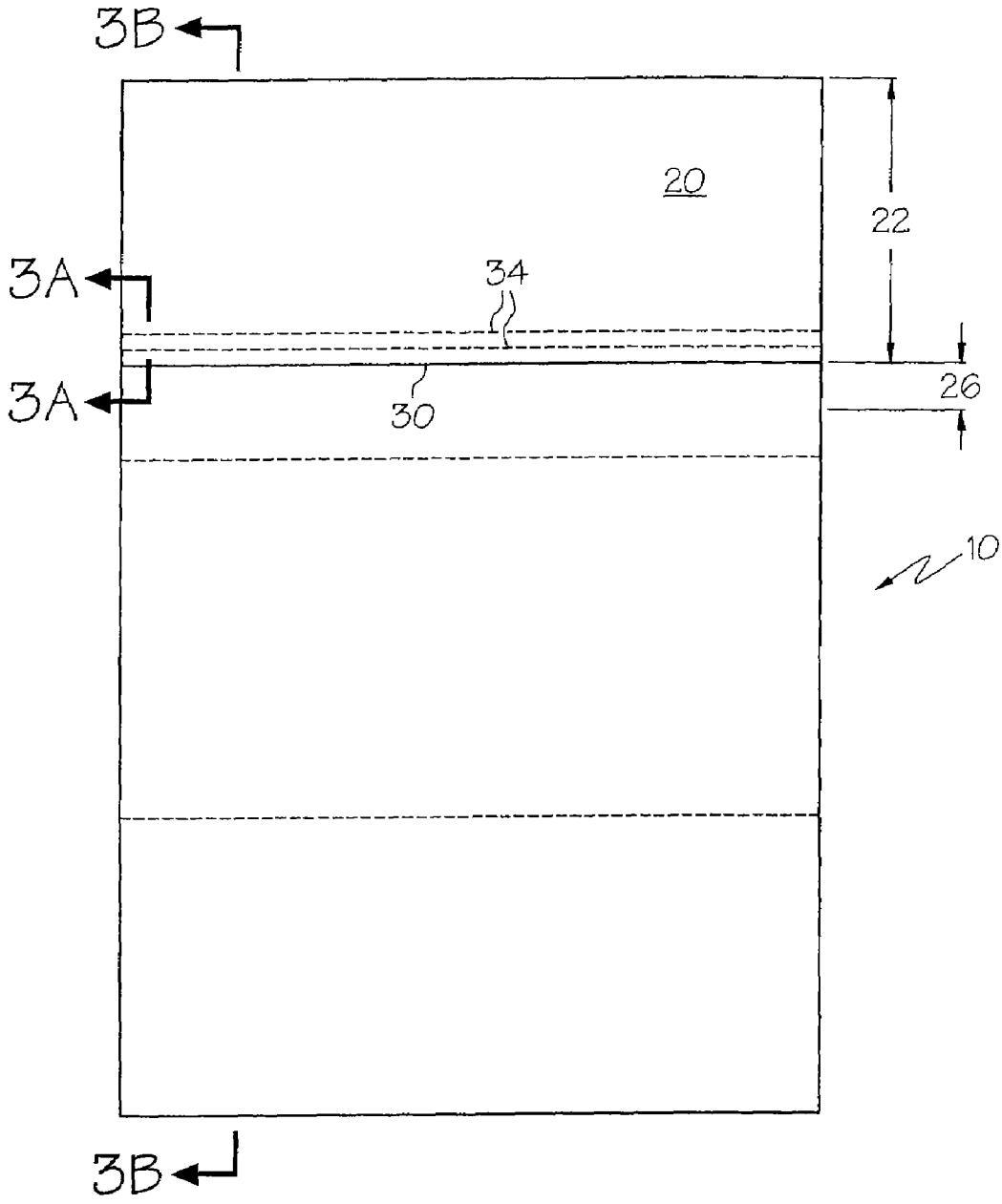
FIG. 2 plan view of the back side of the business form of FIG. 1.
Figure 3A:
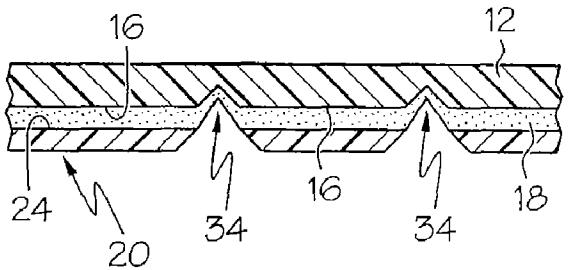
FIG. 3A is an enlarged sectional view, taken generally along line 3A-3A in FIG. 2.
Figure 3B:
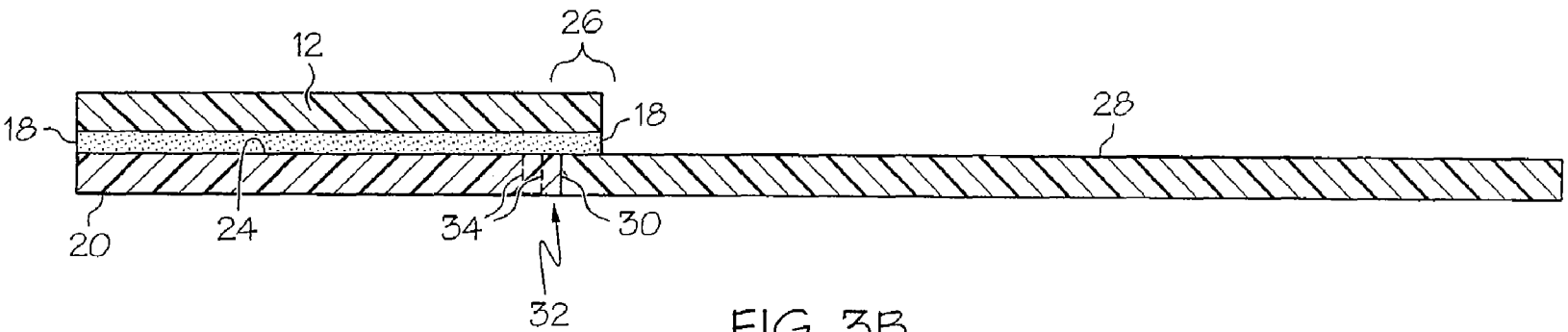
FIG. 3B is a sectional view, taken generally along line 3B-3B in FIG. 2.

Reference is made to FIGS. 1, 2, 3A and 3B which illustrate a first embodiment of the business form of the present invention. FIG. 1 is a plan view of the front of the business form, and FIG. 2 is a plan view of the back of the business form of FIG. 1. FIG. 3A is an enlarged partial sectional view taken generally along line 3A-3A in FIG. 2, and FIG. 3B is a sectional view, taken generally along line 3B-3B in FIG. 2. None of FIGS. 1-8 are drawn to scale, either with respect to each other or with respect to the relative dimensions of any of the portions of the illustrated business form. Rather, various dimensions are exaggerated for clarity of illustration and ease of understanding.

The business form 10 is shown as a cut sheet form. However, it will be appreciated that the form 10 may also be configured as a continuous form. The form 10 has a ply 12 of label stock of a desired width 14. Ply 12 has one side 16 coated with a pressure sensitive adhesive 18. A ply 20 of release liner stock of a width 22 has a release side 24 engaged with the adhesive 18. Side 24 is typically silicone coated to facilitate is separation from adhesive 18. A plurality of die cuts 25 in the label stock 12 define individual labels that may be peeled away from the release liner ply 20. An edge of release liner ply 20 and an edge of label stock ply 12 are laterally offset from one another so that a narrow longitudinal strip of adhesive 18 is unengaged with the release liner, as indicated at 26. This may be accomplished by making liner ply 20 narrower than label ply 12, as shown, or using a liner ply and a label ply of substantially the same width and shifting the liner ply 20 sideways with respect to the label ply 12. A ply 28 of message bearing stock is adhered at one edge 30 to the ply 12 of label stock at the narrow longitudinal strip of adhesive indicated at 26. The label stock and the record or message bearing stock are preferably made of different materials so that each can be selected with optimum performance for its intended function.

Figure 8:
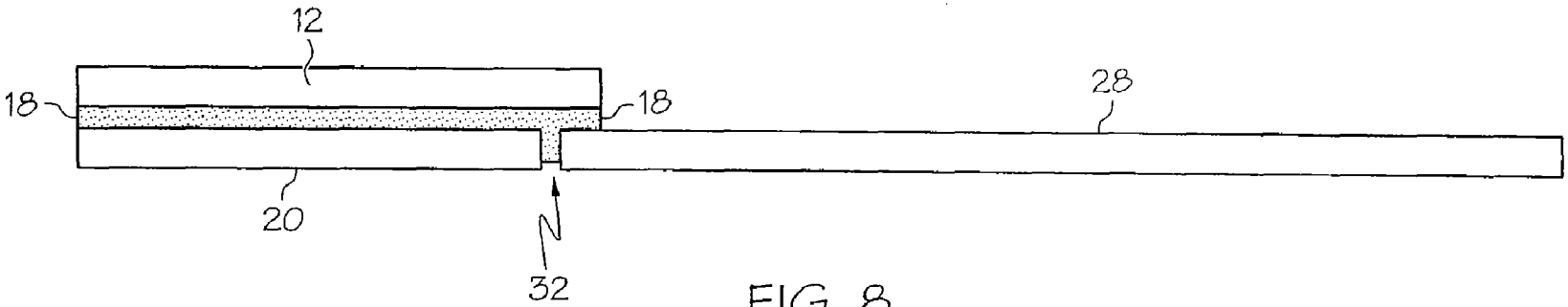
FIG. 8 is an edge view of a prior art business form, illustrating a difficulty encountered with the use of such form.

A problem that has been encountered with business forms of this general type is that the overlapping plies may tend to come apart, especially while the forms are being duplex-imaged through a laser printer. As illustrated in FIG. 8, forms of this type have in the past exhibited occasions where the seam 32 has pulled apart somewhat, exposing a line of adhesive 18 which can be 1/32 inch to 1/16 inch in width. It will be appreciated that printing a series of business forms that separate and expose even a small amount of adhesive in this manner may, over time, cause the feed path of the laser printer or other document handling device to become fouled, resulting in document jams. It is thought that the heat from the laser rollers may soften the adhesive. Due to the double cycle and dwell time involved in duplex printing the form, such printing may exacerbate the deterioration of the forms.

The present invention avoids this problem by providing a plurality of cuts 34 that are defined by, and extend through, the release liner ply 20. By this arrangement, the structural integrity of the business form 10 is enhanced. Cuts 34, such as the perforation lines 34 shown in FIGS. 2, 3A, 3B, and 4, are die cut parallel to the liner edge on the back of the form adjacent the seam 32 joining the two plies 20 and 28, and adjacent the edge 30 of the ply 28. As may be noted from FIG. 3A, the cuts penetrate the line ply 20 and adhesive 18, and may distort the shape of label 12 by slightly.

The mechanism by which the present invention operates is not understood precisely, but there are at least three theories that offer some explanation. First, liner perforations 34 through the silicone coating may permit the adhesive 18 to contact non-siliconized paper fibers therebelow, perhaps adding just enough "bite" to keep the seam 32 from separating. Second liner perforations running parallel to and closely adjacent to the liner edge 30 may provide just enough added flexibility (less stiffness) to prevent this edge 30 from lifting while the form is traveling over feed and print rollers inside a printer. Third, the liner perforations 34 may create a very slight interlocking "dimple" effect relationship between the label ply 12 and liner 20, increasing resistance to "shearing" between the liner 20 and the label stock 12. This is diagrammatically shown in FIG. 3A.

The die cuts may be of various designs, but are always positioned near the seam 32, cutting through the ply of release material from the back side of the form to the adhesive 18. The die cuts 34 are preferably arranged in a pair of perforation lines that extend along the release liner 20 adjacent the one edge 30 of the message bearing stock 28. In some instances, however, a single line of die cuts may be used. As may be noted in FIGS. 2 and 4, the perforation lines in this embodiment are made up of cuts 34 that extend generally parallel to the perforation lines.

Figure 4:
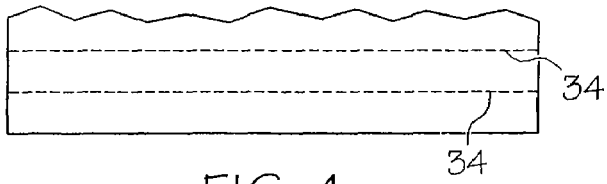
FIG. 4 is a partial plan view of the ply of release liner stock of the embodiment of FIG. 1.
Figure 5:
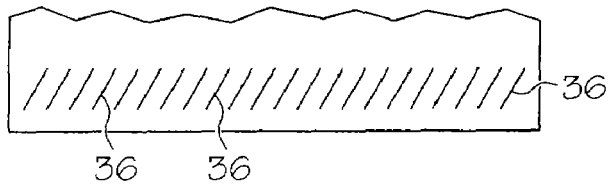
FIG. 5 is a partial plan view of the ply of release liner stock of the a second embodiment of the invention.
Figure 6:
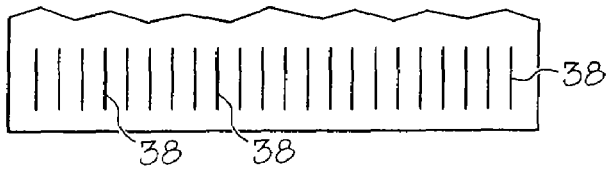
FIG. 6 is a partial plan view of the ply of release liner stock of the a third embodiment of the invention.
Figure 7:
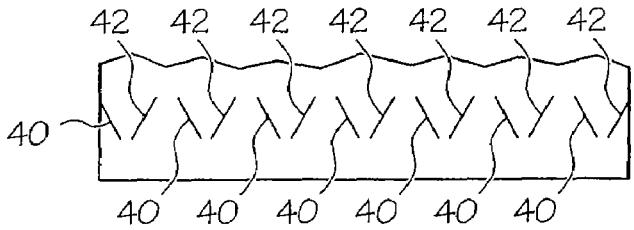
FIG. 7 is a partial plan view of the ply of release liner stock of the a fourth embodiment of the invention.

As an alternative to the embodiment of FIGS. 1-4, the row or rows of die cuts may include die cuts 36, shown in FIG. 5, that extend at an oblique angle to the row. As a further alternative to the embodiments of FIGS. 1-5, the row or rows of die cuts may include die cuts 38 that extend generally perpendicular to the row. The die cuts in these two embodiments are generally parallel to each other. In another embodiment, however, the die cuts are not parallel, but rather can be divided into two groups. As shown in FIG. 7, the die cuts comprise a first group of generally parallel die cuts 40 inclined at a first oblique angle to the row of die cuts. The die cuts further comprise a second group of generally parallel die cuts 42 interleaved with the first group and inclined at a second oblique angle to the row of die cuts. The first oblique angle is a positive angle and the second oblique angle is a negative angle, as illustrated.

In testing it was determined that the embodiment of FIG. 4 was the most effective. The embodiment of FIG. 6 was found to be the least effective, and the embodiments of FIGS. 5 and 7 were found to be of intermediate effectiveness. While certain representative embodiments and details have been shown for purposes of illustrating the invention, it will be apparent to those skilled in the art that various changes in the business form disclosed herein may be made without departing from the scope of the invention, which is defined in the appended claims.

What is claimed is:

1. A business form comprising:

a ply of label stock having one side coated with a pressure sensitive adhesive;

a ply of release liner stock having a release side engaged with said adhesive on said one side;

an edge of said ply of release liner stock and an edge of said ply of label stock being laterally offset from one another so that a longitudinal strip of adhesive is unengaged with said ply of release liner stock;

a ply of message bearing stock adhered at one edge to said ply of label stock at said narrow longitudinal strip of adhesive; and a plurality of cuts defined by, and extending through, said ply of release liner stock whereby the structural integrity of said business form is enhanced, said plurality of cuts not extending through said ply of label stock.

2. The business form of claim 1 wherein said plurality of cuts comprise a pair of die cut perforation lines extending along said ply of release liner stock adjacent said one edge of said message bearing stock.

3. The business form of claim 2 wherein said plurality of die cuts comprise a pair of perforation lines made up of cuts extending generally parallel to said perforation lines.

4. The business form of claim 1 wherein said plurality of die cuts comprise a row of die cuts extending along said ply of release liner stock adjacent said one edge of said message bearing stock.

5. The business form of claim 4 in which said die cuts extend generally perpendicular to said row of die cuts.

6. The business form of claim 4 in which said die cuts extend at an oblique angle to said row of die cuts.

7. The business form of claim 6 in which said die cuts are generally parallel to each other.

8. The business form of claim 6 in which said die cuts comprise a first group of generally parallel die cuts inclined at a first oblique angle to said row of die cuts interleaved with a second group of generally parallel die cuts inclined at a second oblique angle to said row of die cuts.

9. The business form of claim 8 in which said first oblique angle is a positive angle and said second oblique angle is a negative angle.

10. The business form of claim 1 wherein said label stock and said message bearing stock are different materials.

11. The business form of claim 1 including die cuts in said ply of label stock defining individual labels that may be peeled from said ply of release liner stock.

12. A method of making a business form comprising:

providing a ply of label stock having one side coated with a pressure sensitive adhesive;

providing a ply of release liner stock having a release side engaged with said adhesive on said one side;

said ply of label stock having an edge that is laterally offset with respect to an edge of the ply of release liner stock so that a longitudinal strip of adhesive is unengaged with said ply of release liner stock;

adhering a ply of message bearing stock at one edge to said ply of label stock at said longitudinal strip of adhesive; and forming a plurality of cuts defined by, and extending through, said ply of release liner stock by cutting through said ply of release liner from the back side of the business form whereby the structural integrity of said business form is enhanced, said plurality of cuts not extending through said ply of label stock.

13. A method of making a business form of claim 12, wherein said plurality of die cuts comprise one or more rows of die cuts extending along said ply of release liner stock adjacent said one edge of said ply of message bearing stock.

14. A business form comprising:

a sheet of label stock having one side coated with a pressure sensitive adhesive;

a sheet of release liner stock having a release side engaged with said adhesive on said one side of said sheet of label stock;

said sheet of release liner stock and said sheet of label stock having edges that are laterally offset from one another so that there is a narrow strip of adhesive unengaged with said release liner;

a sheet of record bearing stock adhered at one edge to said sheet of label stock at said narrow strip of adhesive; and a plurality of cuts defined by, and extending through, said sheet of release liner stock whereby the structural integrity of said business form is enhanced, said plurality of cuts not extending through said sheet of label stock.

15. The business form of claim 14 wherein said plurality of cuts comprise a pair of die cut perforation lines extending along said sheet of release liner stock adjacent said one edge of said sheet of record bearing stock.

16. The business form of claim 13 wherein said plurality of die cuts comprise a pair of perforation lines made up of cuts extending generally parallel to said perforation lines.

17. The business form of claim 14 wherein said plurality of die cuts comprise a row of die cuts extending along said sheet of release liner stock adjacent said one edge of said sheet of message bearing stock.

18. The business form of claim 17 in which said die cuts extend generally perpendicular to said row of die cuts.

19. The business form of claim 17 in which said die cuts extend at an oblique angle to said row of die cuts.

20. The business form of claim 19 in which said die cuts are generally parallel to each other.

21. The business form of claim 19 in which said die cuts comprise a first group of generally parallel die cuts inclined at a first oblique angle to said row of die cuts interleaved with a second group of generally parallel die cuts inclined at a second oblique angle to said row of die cuts.

22. The business form of claim 21 in which said first oblique angle is a positive angle and said second oblique angle is a negative angle.

23. The business form of claim 14 wherein said label stock and said record bearing stock are different materials.

24. The business form of claim 14 including die cuts in said sheet of label stock defining individual labels that may be peeled from said sheet of release liner stock.

* * * * *